US008621672B2

(12) United States Patent
Chuback

(10) Patent No.: US 8,621,672 B2
(45) Date of Patent: Jan. 7, 2014

(54) HEAD AND NECK PROTECTION APPARATUS

(76) Inventor: John Chuback, Allendale, NJ (US)

( * ) Notice: Subject to any disclaimer, the term of this patent is extended or adjusted under 35 U.S.C. 154(b) by 294 days.

(21) Appl. No.: 13/102,843

(22) Filed: May 6, 2011

(65) Prior Publication Data

US 2012/0278980 A1 Nov. 8, 2012

(51) Int. Cl.
*A42B 3/00* (2006.01)
*A42B 7/00* (2006.01)

(52) U.S. Cl.
USPC ..... 2/425; 2/421

(58) Field of Classification Search
USPC ..... 2/410, 416, 421, 425, 2.11, 468, 411, 2/424; 602/18
See application file for complete search history.

(56) References Cited

U.S. PATENT DOCUMENTS

| | | | | |
|---|---|---|---|---|
| 1,163,247 | A | | 12/1915 | McGrew |
| 2,682,235 | A | | 6/1954 | Buckminster |
| 3,134,106 | A | | 5/1964 | Archie et al. |
| 3,421,188 | A | * | 1/1969 | Rock ..... 24/443 |
| 3,462,763 | A | | 8/1969 | Schneider et al. |
| 3,488,771 | A | * | 1/1970 | Chase et al. ..... 2/2.11 |
| 3,514,785 | A | * | 6/1970 | Smith ..... 2/410 |
| 3,609,764 | A | | 10/1971 | Morgan |
| 3,671,974 | A | | 6/1972 | Sims |
| 3,707,004 | A | | 12/1972 | Kapitan et al. |
| 3,818,509 | A | | 6/1974 | Romo et al. |
| 3,820,163 | A | | 6/1974 | Rappleyea |
| D233,635 | S | | 11/1974 | Litsinger, Sr. |
| 3,873,996 | A | * | 4/1975 | Varteressian ..... 2/421 |
| 3,879,761 | A | | 4/1975 | Bothwell |
| 3,897,598 | A | | 8/1975 | Bednarczuk et al. |
| 3,900,896 | A | | 8/1975 | Ackerman |
| 3,958,275 | A | | 5/1976 | Morgan et al. |
| 3,978,525 | A | | 9/1976 | Bothwell |
| 3,991,421 | A | | 11/1976 | Stratten |
| 4,015,295 | A | * | 4/1977 | Lancaster et al. ..... 2/2.15 |
| 4,034,416 | A | * | 7/1977 | Buffkin et al. ..... 2/2.15 |
| 4,057,058 | A | * | 11/1977 | Kovacevic ..... 128/201.23 |
| 4,060,855 | A | | 12/1977 | Rappleyea |
| 4,091,465 | A | * | 5/1978 | Webbon et al. ..... 2/2.11 |
| 4,219,193 | A | | 8/1980 | Newman |
| 4,236,514 | A | * | 12/1980 | Moretti ..... 128/201.23 |
| 4,423,524 | A | | 1/1984 | Kralik et al. |

(Continued)

FOREIGN PATENT DOCUMENTS

| | | |
|---|---|---|
| CA | 2039185 | 9/1992 |
| DE | 2825145 | 12/1979 |

(Continued)

*Primary Examiner* — Alissa L Hoey
(74) *Attorney, Agent, or Firm* — Levine Bagade Han LLP

(57) ABSTRACT

In certain variations, head and/or neck protection apparatus and methods are provided. A head and/or neck protection apparatus may include shoulder pads, a collar and/or a helmet. The shoulder pads may include a central opening for receiving a user's neck. A collar may extend from the periphery of the central opening or the collar may be positioned at or around the periphery of the central opening. The helmet may surround but remain spaced apart from a user's head. The helmet may be removably connected or fastened to the collar or shoulder pads. The helmet may be connected or fasted to the collar or shoulder pads such that the helmet cannot move relative to the shoulder pads and a force applied to the helmet is distributed to the collar and transferred to the shoulder pads, shoulders, chest and/or back of a user.

7 Claims, 9 Drawing Sheets

(56) References Cited

U.S. PATENT DOCUMENTS

| | | | | | |
|---|---|---|---|---|---|
| 4,553,270 | A | * | 11/1985 | Hoffmann | 2/421 |
| 4,605,000 | A | | 8/1986 | Anguita | |
| 4,613,993 | A | | 9/1986 | Steele et al. | |
| 4,638,510 | A | | 1/1987 | Hubbard | |
| 4,641,382 | A | * | 2/1987 | Gessalin | 2/421 |
| 4,825,476 | A | | 5/1989 | Andrews | |
| 4,982,451 | A | | 1/1991 | Graham | |
| 4,999,855 | A | | 3/1991 | Brown | |
| 5,029,341 | A | | 7/1991 | Wingo | |
| 5,123,408 | A | | 6/1992 | Gaines | |
| 5,261,125 | A | | 11/1993 | Cartwright et al. | |
| 5,295,271 | A | | 3/1994 | Butterfield et al. | |
| 5,353,437 | A | | 10/1994 | Field et al. | |
| 5,371,905 | A | * | 12/1994 | Keim | 2/413 |
| 5,390,367 | A | * | 2/1995 | Rush, III | 2/462 |
| 5,404,590 | A | * | 4/1995 | Monica, Jr. | 2/468 |
| 5,444,870 | A | | 8/1995 | Pinsen | |
| 5,493,736 | A | | 2/1996 | Allison | |
| 5,517,699 | A | | 5/1996 | Abraham | |
| 5,546,601 | A | | 8/1996 | Abeyta | |
| 5,553,330 | A | | 9/1996 | Carveth | |
| 5,566,399 | A | | 10/1996 | Cartwright et al. | |
| 5,581,816 | A | | 12/1996 | Davis | |
| 5,715,541 | A | | 2/1998 | Landau | |
| 5,790,988 | A | | 8/1998 | Guadagnino et al. | |
| 5,794,270 | A | | 8/1998 | Howat | |
| 5,930,843 | A | | 8/1999 | Kelly | |
| 6,006,368 | A | | 12/1999 | Phillips | |
| 6,052,835 | A | | 4/2000 | O'Shea | |
| RE36,691 | E | | 5/2000 | Pinsen | |
| 6,065,158 | A | | 5/2000 | Rush | |
| 6,138,283 | A | | 10/2000 | Kress | |
| 6,161,240 | A | | 12/2000 | Huang | |
| 6,182,300 | B1 | | 2/2001 | Severance | |
| 6,219,850 | B1 | | 4/2001 | Halstead et al. | |
| 6,226,801 | B1 | | 5/2001 | Alexander et al. | |
| 6,240,571 | B1 | | 6/2001 | Infusino | |
| 6,253,389 | B1 | * | 7/2001 | Scaglione | 2/456 |
| 6,292,954 | B1 | | 9/2001 | O'Bradaigh et al. | |
| 6,298,483 | B1 | | 10/2001 | Schiebl et al. | |
| 6,314,586 | B1 | | 11/2001 | Duguid | |
| 6,332,226 | B1 | | 12/2001 | Rush | |
| 6,351,853 | B1 | | 3/2002 | Halstead et al. | |
| 6,371,710 | B1 | | 4/2002 | Ide et al. | |
| 6,378,140 | B1 | | 4/2002 | Abraham et al. | |
| 6,385,781 | B1 | | 5/2002 | Rose et al. | |
| 6,434,756 | B1 | | 8/2002 | Hoop | |
| 6,438,762 | B1 | | 8/2002 | Jenkins | |
| 6,499,147 | B2 | | 12/2002 | Schiebl et al. | |
| 6,588,022 | B1 | | 7/2003 | Anders et al. | |
| 6,591,430 | B1 | * | 7/2003 | Sledge | 2/468 |
| 6,763,524 | B2 | | 7/2004 | Halstead et al. | |
| 6,810,535 | B1 | | 11/2004 | Moloney | |
| 6,854,459 | B1 | * | 2/2005 | Cox | 128/201.23 |
| 6,874,170 | B1 | | 4/2005 | Aaron | |
| 6,931,671 | B2 | | 8/2005 | Skiba | |
| 6,934,971 | B2 | | 8/2005 | Ide et al. | |
| 6,968,576 | B2 | | 11/2005 | McNeil et al. | |
| 6,971,123 | B2 | | 12/2005 | Weaver | |
| 7,120,941 | B2 | | 10/2006 | Glaser | |
| 7,328,462 | B1 | | 2/2008 | Straus | |
| 7,430,767 | B2 | | 10/2008 | Nagely | |
| 7,650,648 | B2 | | 1/2010 | Roberts | |
| 7,754,791 | B2 | | 7/2010 | Sereboff | |
| 7,849,525 | B2 | | 12/2010 | Ghajar | |
| 8,191,180 | B2 | * | 6/2012 | Berry | 2/468 |
| 2004/0000007 | A1 | * | 1/2004 | Scagline | 2/455 |
| 2007/0157371 | A1 | | 7/2007 | Nagely | |
| 2007/0163032 | A1 | | 7/2007 | Kerr | |
| 2007/0245464 | A1 | | 10/2007 | Baker | |
| 2008/0209617 | A1 | * | 9/2008 | Castillo | 2/461 |
| 2008/0282453 | A1 | * | 11/2008 | Alstin et al. | 2/413 |
| 2008/0313791 | A1 | | 12/2008 | Nagely | |
| 2009/0044314 | A1 | * | 2/2009 | Newman | 2/411 |
| 2010/0083424 | A1 | | 4/2010 | Linares | |
| 2010/0186150 | A1 | | 7/2010 | Ferrara et al. | |
| 2010/0192290 | A1 | | 8/2010 | Husain | |
| 2010/0204628 | A1 | | 8/2010 | Ghajar | |
| 2010/0263110 | A1 | * | 10/2010 | Berry | 2/459 |

FOREIGN PATENT DOCUMENTS

| | | |
|---|---|---|
| EP | 0205514 | 3/1982 |
| EP | 0047712 | 5/1984 |
| EP | 0108694 | 12/1986 |
| GB | 2240255 | 7/1991 |
| JP | 1986066906 | 4/1986 |
| JP | 1994166906 | 6/1994 |
| WO | WO 86/03655 | 7/1986 |
| WO | WO 2010/058229 | 5/2010 |
| WO | WO 2010/067133 | 6/2010 |

* cited by examiner

HEAD AND NECK PROTECTION APPARATUS

FIELD OF THE INVENTION

The present apparatus and methods relate generally to an improved head and/or neck protection apparatus which disperses a force applied to the head, to the shoulders to reduce or prevent injury to the neck, spine and/or head during sporting or other physical activities.

BACKGROUND

Catastrophic injuries often occur in football, hockey, and other sports and activities as a result of excessive axial loading on the cervical spine and excessive force applied to the head. Such injuries are now occurring more frequently because participants in sporting and other physical activities are much larger and weigh considerably more than in previous years. In recent years, concussions and C-Spine injuries have become a huge issue in the country and particularly in the National Football League. Numerous players careers were shortened because of recurrent concussions with long term neurological consequences. There have also been numerous cases of paraplegia and quadriplegia. Although there has been a great deal of improvement in helmets, the magnitude of kinetic energy generated by impacts cannot be adequately dissipated or dampened by the current generation of protective headwear.

Therefore, there remains a need for improved head and neck protective devices that reduce or prevent injury to the neck, spine or head during sporting or other physical activities

BRIEF SUMMARY

Variations of head and/or neck protection apparatus and methods for distributing or dispersing force applied to a head or helmet are described herein.

A variation of a head and/or neck protection apparatus may include shoulder pads and a helmet. The shoulder pads include a central opening for receiving a user's neck. A collar may extend from the periphery of the central opening or the collar may be positioned at or around the periphery of the central opening. The helmet may surround but remain spaced apart from a user's head. The helmet may be removably connected or fastened to the collar or shoulder pads. The helmet may be connected or fasted to the collar or shoulder pads such that the helmet cannot move relative to the shoulder pads and a force applied to the helmet may be distributed circumferentially or peripherally to the collar and transferred to the shoulder pads, shoulders, chest and/or back of a user.

A variation of a helmet apparatus is provided. The helmet may be used with shoulder pads that remain underneath a user's jersey to protect the user's head and neck from an impact force. The helmet may include a dome portion configured to surround but remain spaced apart from the user's head. The helmet may have a bottom periphery surrounding an opening in the helmet for receiving the user's head. The bottom periphery of the helmet may be substantially lockable to the shoulder pads such that when locked the helmet cannot move relative to the shoulder pads. A force applied to the helmet may be distributed to the bottom periphery of the helmet and/or to the shoulder pads. The helmet may be removable from the shoulder pads by the user without removing the user's jersey.

A variation of a method for dispersing or distributing a force applied to a helmet to the shoulders, back and/or chest of a user is provided. Shoulder pads having a central opening for receiving a user's neck and/or head, and optionally having a collar extending from the periphery of the central opening or positioned at or around the periphery of the central opening are provided. The shoulder pads may be applied to the shoulders of a user. A helmet may be securely fastened or connected to a collar and/or the shoulder pads such that the helmet cannot move relative to the shoulder pads. Once connected to a collar and/or the shoulder pads, the helmet may surround but remain spaced apart from the user's head such that the user can turn their head fully in any direction within the helmet. A force applied to the helmet may be circumferentially or peripherally distributed or dispersed to a collar and/or the shoulder pads, thereby transferring the force to the shoulder pads, shoulders, chest, and/or back of the user.

DETAILED DESCRIPTION

Figure 1:
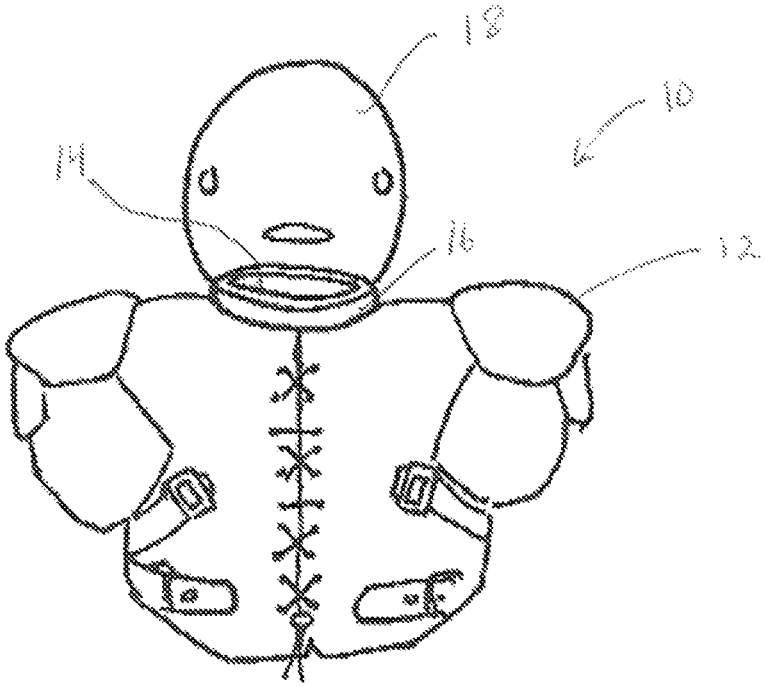
FIG. 1 illustrates a front view of a variation of a head and neck protection apparatus.

FIG. 1 illustrates one variation of head and neck protection apparatus 10. The protection apparatus 10 may include shoulder pads 12. The shoulder pads 12 include a central opening 14 or aperture through which a user's neck and/or head may pass. In certain variations, the shoulder pads 12 may include a right shoulder cover, left shoulder cover, a chest cover, and/or a back cover. Optionally, the chest and/or back covers may extend over substantially the entire torso. Optionally, the right and left shoulder covers may extend to cover any portion of the arms.

As shown in FIG. 1, in certain variations, a collar 16 may extend from the periphery of the central opening 14, e.g., upward from the periphery of the central opening. The apparatus 10 may also include a helmet 18. The helmet 18 may surround but remain spaced apart from the user's head. Indeed, the helmet 18 does not engage with the user's head, allowing the user to move their head independently from the helmet and fully in any direction within the helmet 18. The helmet 18 may be removably connected or fastened to the collar 16. When the helmet 18 is securely connected, fastened, locked or affixed to the collar 16, the helmet cannot move relative to the shoulder pads 12. Once connected, the helmet 18 and shoulder pads 12 may act as a single unit with no or little mobility between the helmet 18 and shoulder pads 16. The collar 16 may include a variety of locking mechanisms to securely fasten or connect the helmet 18 to the shoulder pads 12.

Figure 2:
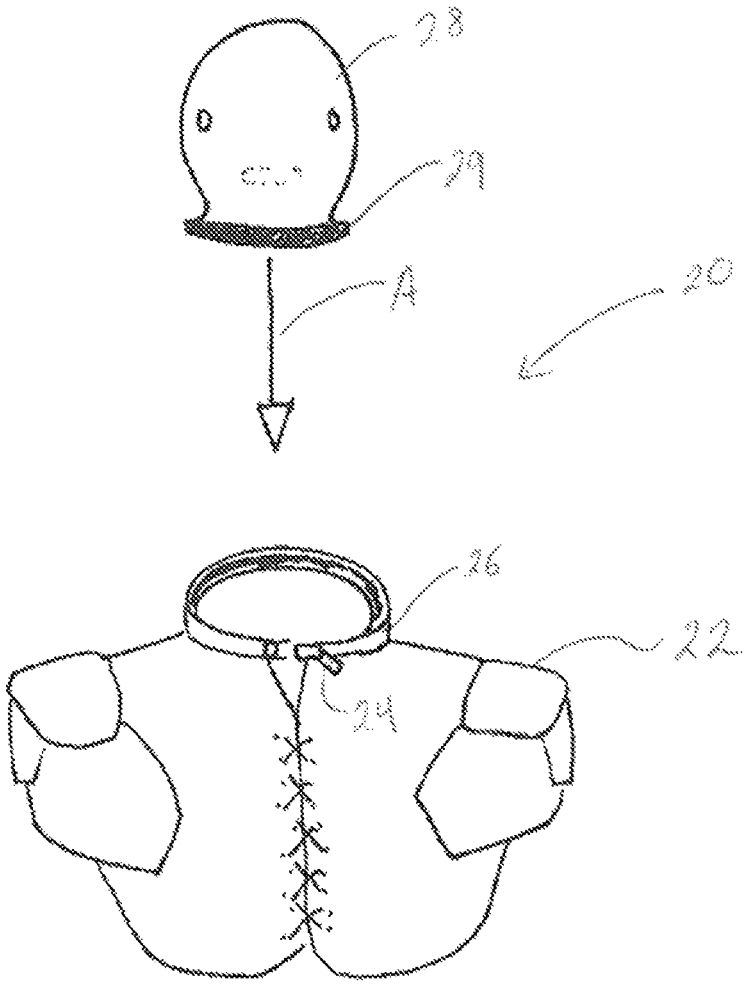
FIG. 2 illustrates a rear view of a variation of a head and neck protection apparatus having a locking mechanism in the form of a latch.

FIG. 2 illustrates one variation of a head and neck protection apparatus 20 including a collar 26 having a locking mechanism in the form of a latch 24. The collar 26 may be expanded or contracted. In use, when the latch 24 is in an opened position, the helmet 28 may be positioned inside the collar 26, as indicated by arrow A. For example, the helmet 28 may include a base 29, bottom lip or bottom periphery surrounding the opening in the helmet for receiving a user's head, which may be inserted or received within the collar 26. Once the helmet 28 is positioned inside the collar 26, the latch 24 is closed, securely locking the helmet 28 to the shoulder pads 22. In the locked position, the helmet 28 cannot move relative to the collar 26 or shoulder pads 22. Optionally, one or more locking mechanisms may be positioned on the collar or on another portion of the apparatus. For example, multiple locking mechanisms may be provided for locking or affixing the helmet to the shoulder pads. A locking mechanism may snap into place and may be in the form of a variety of designs or configurations. For example, a latch similar to a latch used on ski boots may be utilized to lock the helmet to the collar and/or shoulder pads.

Figure 3:
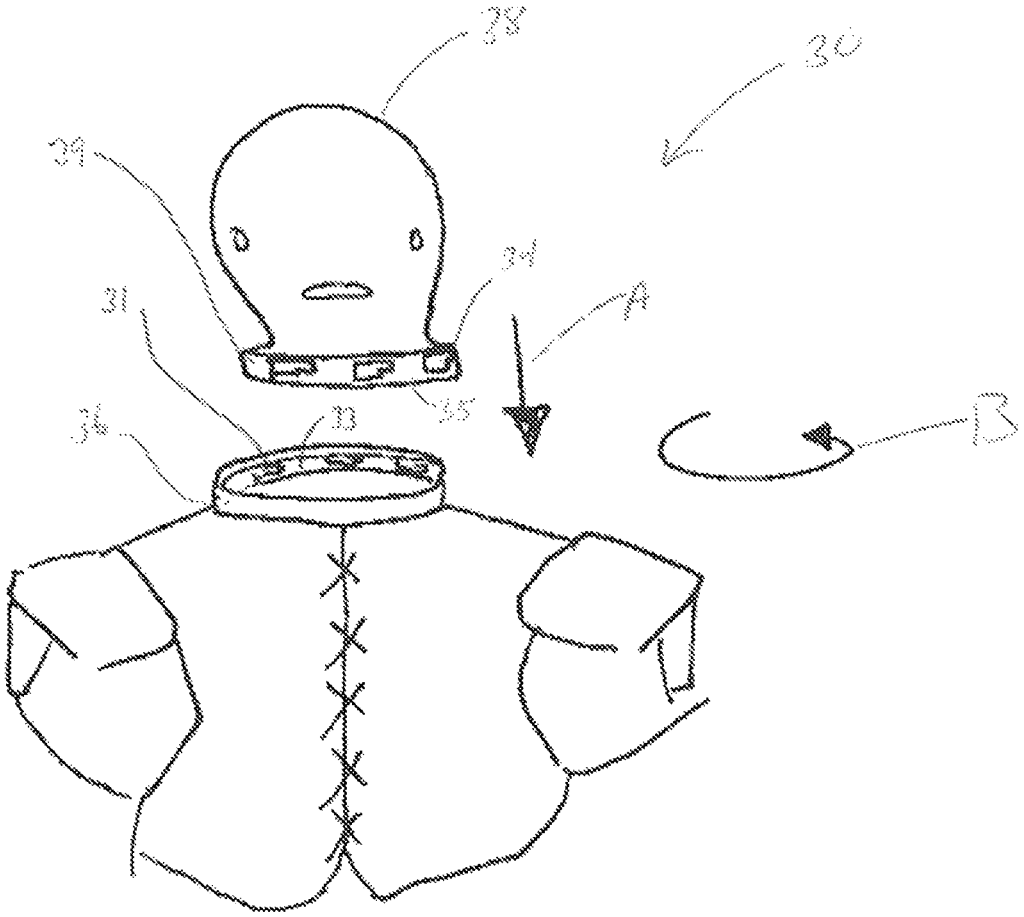
FIG. 3 illustrates a front view of a variation of head and neck protection apparatus having a protrusion/slot rotatable locking mechanism.

FIG. 3 illustrates another variation of a head and neck protection apparatus 30 including a collar 36 having another variation of a locking mechanism. The collar 36 includes one or more slots 31 or openings located along an inner surface 33 of the collar 36. A helmet 38 is provided. The helmet 38 includes one or more protrusions 34 or tabs located along an outer surface 35 of the base 39, bottom lip or bottom periphery of the helmet 38. In another variation, the arrangement of protrusions and slots or openings may be reversed where the collar may include one or more protrusions or tabs located along an outer surface of the collar and the helmet may include one or more slots or openings located along an inner surface of the base or bottom lip or periphery of the helmet.

In use, the helmet 38 is inserted or pushed down into the collar 36 (as indicated by arrow A), such that the base 39 is received or inserted within the collar 36. The protrusions 34 are aligned with the slots 31 and inserted into the slots 31. The helmet 38 is then rotated (as indicated by arrow B), rotating the base 39 (clockwise or counter-clockwise depending on the design or configuration of the slots) relative to the collar 36. Rotation of the helmet causes the protrusions to slide and lock within the slots 31. As a result, the helmet 38 is securely locked or fastened to the shoulder pads 32 and the helmet 38 cannot move relative to the collar or shoulder pads 32.

In another variation, the protrusions or tabs may be configured to snap into slots or openings in a collar or helmet, locking the helmet to the collar and shoulder pads.

In certain variations, the helmet may include an o-ring or a gasket positioned at the base or bottom lip or periphery of the helmet. The o-ring or gasket may provide a tight locking seal between the helmet and the collar to securely fasten and/or lock the helmet to the shoulder pads.

In another variation, the collar or shoulder pads may include an o-ring or a gasket, which provides a tight locking seal between the helmet and collar and/or shoulder pads. Optionally, the collar, shoulder pads and/or the helmet may include an o-ring, gasket or other component or mechanism for providing a sealing engagement, lock or seal between the collar and/or shoulder pads and helmet.

Figure 4:
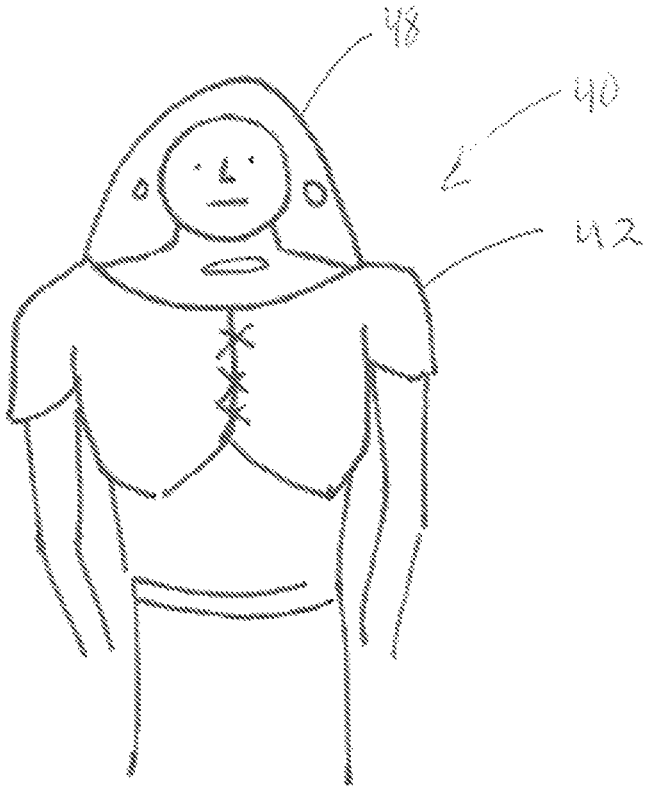
FIG. 4 illustrates another variation of a head and neck protection apparatus including a helmet in the form of a clear dome.

FIG. 4 illustrates another variation of a head and neck protection apparatus 40 including a helmet in the form of a clear dome 48 having a substantially conical shape or a shape or design where the circumference of the dome 48 increases in size from the crown of the dome 48 to the base or bottom of the dome 48. The base or bottom periphery of the dome 48 contacts the shoulder pads 42 and/or attaches the dome to the shoulder pads 42 or to a collar optionally on the shoulder pads. The entire or substantially the entire base or bottom periphery of the dome may be in contact with the shoulder pads and/or a collar on the shoulder pads. Once the dome 58 and shoulder pads 52 are securely connected, force applied to the dome 48 may be equally or substantially equally distributed or dispersed circumferentially or peripherally from the base, bottom periphery or bottom of the dome 48 to and/or over the shoulder pads 42 (and/or a collar or other extension of the shoulder pads), transferring the force to the shoulders, back and/or chest of the user.

Figure 5A:
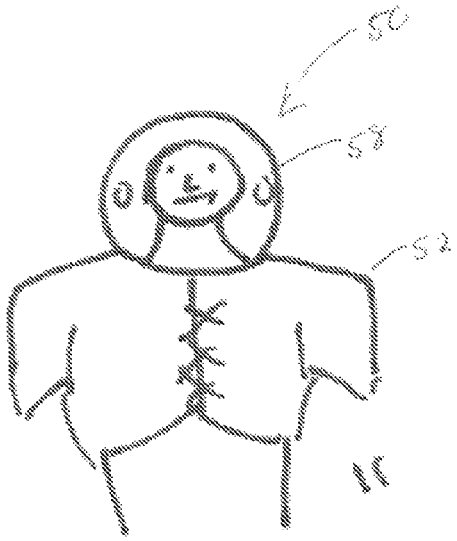
FIGS. 5A and 5B illustrate front and side views of another variation of a head and neck protection apparatus including a helmet in the form of a clear dome
Figure 5B:
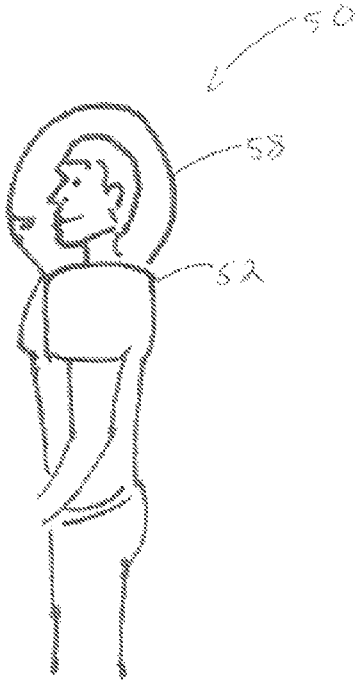

FIGS. 5A and 5B illustrate front and side views of another variation of a head and neck protection apparatus 50 including a helmet in the form of a clear dome 58 having a substantially spherical shape or a shape or design where the circumference of the dome 58 decreases in size from the middle of the dome to the base of the dome 58. The base or bottom periphery of the dome 58 contacts the shoulder pads 52 and/or attaches the dome to the shoulder pads 52 and/or to a collar optionally on the shoulder pads. The entire or substantially the entire base or bottom periphery of the dome may be in contact with the shoulder pads and/or a collar on the shoulder pads. Once the dome 58 and shoulder pads 52 are securely connected, force applied to the dome 58 may be equally or substantially equally distributed or dispersed circumferentially or peripherally from the base, bottom periphery or bottom of the dome 58 to and/or over the shoulder pads 52 (and/or a collar or other extension of the shoulder pads), transferring the force to the shoulders, back and/or chest of the user.

Figure 6:
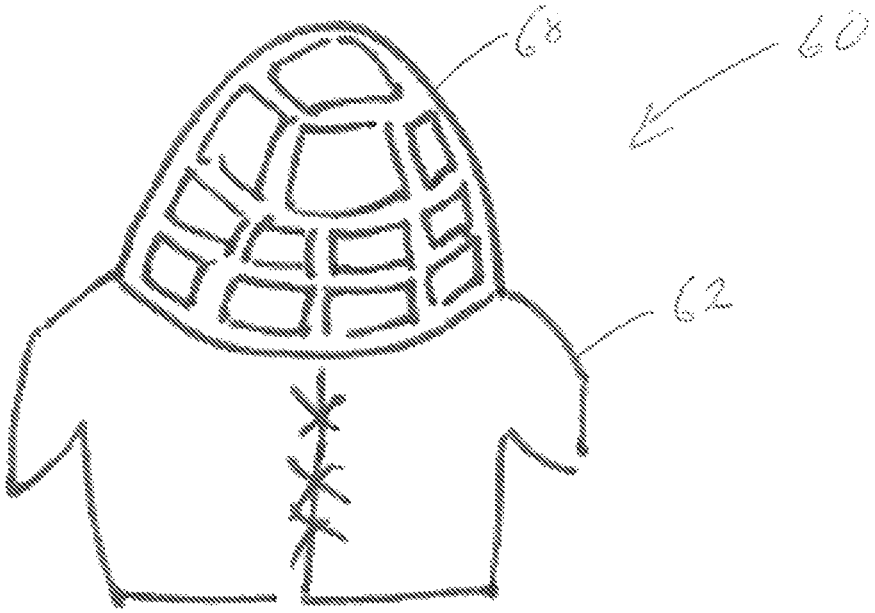
FIG. 6 illustrates another variation of a head and neck protection apparatus including a helmet in the form of a cage.

FIG. 6 illustrates another variation of a head and neck protection apparatus 60 including a helmet in the form of a cage 68. The cage 68 may be made from a variety of materials suitable for withstanding an impact or loading force, e.g., metal. Optionally, the cage may be wrapped in rubber or encased in other padded-type material, such as the materials used to construct facemasks for helmets currently in the market. The cage may be substantially conical or spherical in shape, or may be any other shape suitable to be worn on the head of a user. The base or bottom periphery of the cage 68 contacts the shoulder pads 62 and/or attaches the cage 68 to the shoulder pads 62 or to a collar optionally on the shoulder pads. The entire or substantially the entire base or bottom periphery of the cage may be in contact with the shoulder pads and/or a collar on the shoulder pads. Once the cage 68 and shoulder pads 62 are securely connected, force applied to the dome 68 may be equally or substantially equally distributed or dispersed circumferentially or peripherally from the base, bottom periphery or bottom of the dome 68 to and/or over the shoulder pads 62 (and/or a collar or other extension of the shoulder pads), transferring the force to the shoulders, back and/or chest of the user.

Figure 7:
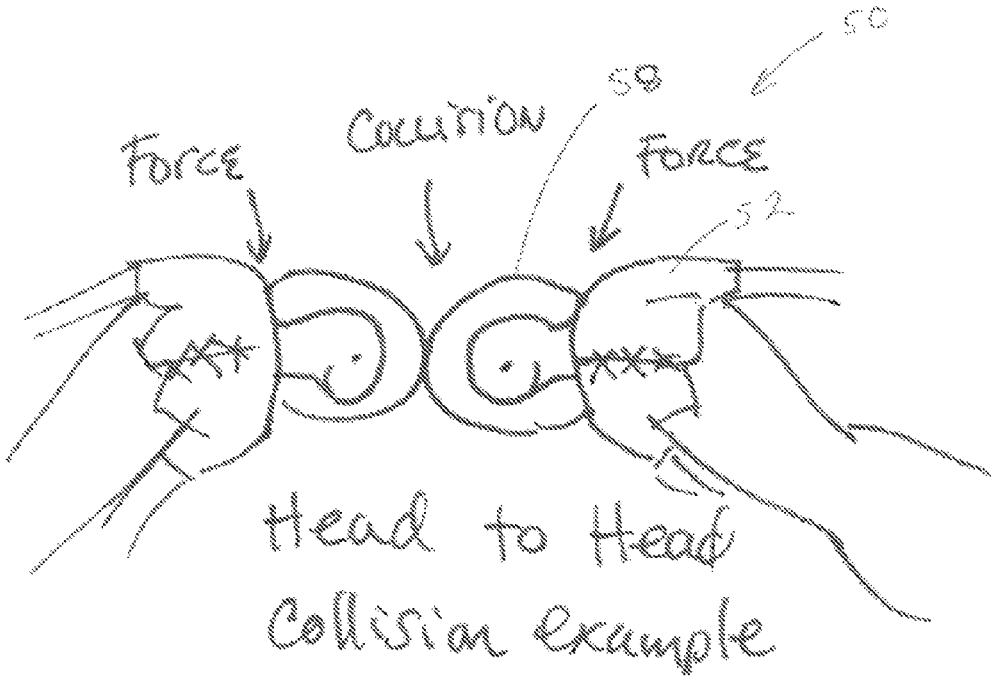
FIG. 7 illustrates a head and neck protection apparatus including a helmet in the form of a dome in use showing the distribution of force during a head-to-head collision.

FIG. 7 illustrates the head and neck protection apparatus 50 in use. During a head to head collision, the force applied to each dome 58 may be equally distributed or dispersed circumferentially or peripherally from the base, bottom or bottom periphery of each dome 58 to the respective shoulder pads 52 (and/or optionally to a collar on the shoulder pads) of the apparatus, transferring the force to the shoulders, back and/or chest of the user.

Figure 8:
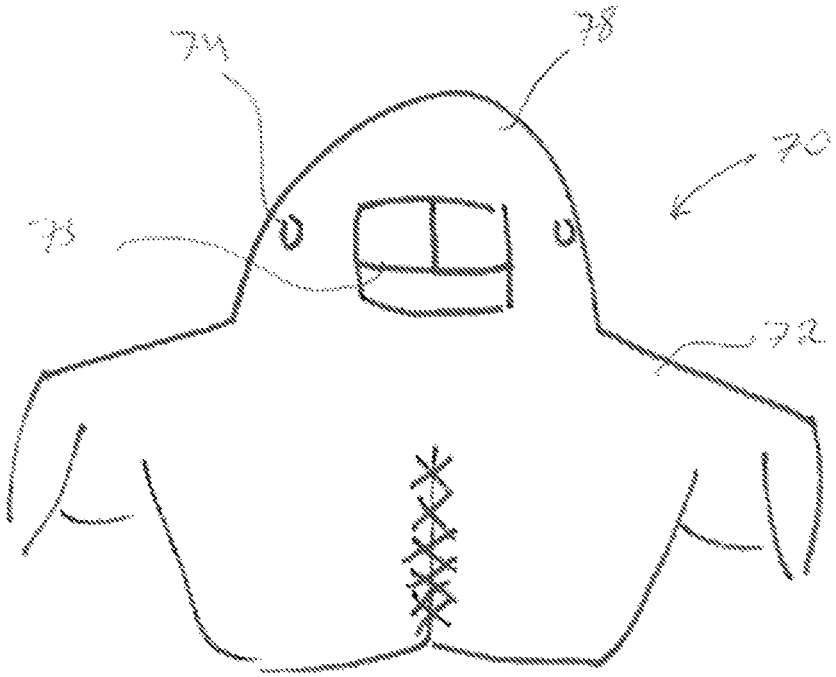
FIG. 8 illustrates another variation of a head and neck protection apparatus.

FIG. 8 illustrates another variation of a head and neck protection apparatus 70 including a dome 78 or helmet and shoulder pads 72 where the dome 78 and shoulder pads 72 are a single unit such that the dome is immobile relative to the shoulder pads 72. The dome 78 and shoulder pads 72 may be a one-piece construction where the dome 78 is molded in conjunction with the shoulder pads 72. For example, the dome 78 may be molded completely from plastic or other suitable material as a part of the shoulder pads 72. The dome 78 may be clear or transparent allowing unobstructed visibility for the user.

The dome 78 may include a face mask 73, e.g., a rubberized and/or steel facemask 73, which may be built into an opening 75 in the front of the dome 78. The face mask may be open or have openings, allowing for ventilation and air such that the apparatus 70 would be tolerable during use, e.g., during a sporting event or game. The open facemask may allow user access to their nose or mouth, e.g., to drink or spit. The open facemask may reduce claustrophobia for users and may improve a user's ability to communicate signals or commands and/or hear communications from others. Ear holes 74 may be provided in the sides of the dome 78. The opening 75, ear holes 74 and/or the facemask 73 may help facilitate breathing and communication by the user, e.g., with teammates, officials or other individuals, when the user is wearing the head and neck protection apparatus 70.

Because the dome 78 and shoulder pads 72 form a single unit, a user would position the dome 78 and shoulder pads 72 onto their body at the same time, and the user would be required to remove the shoulder pads 72 in order to remove the dome 78 and vice versa. The dome 78 may not be removable from the user without also removing the shoulder pads as the components are part of a single unit or construct.

Once in position on the user, the dome 78 may surround but remain spaced apart from the user's head. The dome 78 may not contact and/or squeeze the user's head. The dome 78 may allow for a wide range of motion of the head, where the head of the user is in spaced relation to the inside surfaces of the dome, providing a user with full or substantially full mobility or motion of the head. This may allow a user to better access their nose or mouth, e.g., to drink or spit. It may reduce claustrophobia for users and may improve the user's ability to communicate signals or commands and/or hear communications from others.

Force applied to the dome 78 may be equally or substantially equally distributed or dispersed circumferentially or peripherally from the dome 78 to the shoulder pads 72 (and/or a collar or other extension of the shoulder pads), transferring the force to the shoulders, back and/or chest of the user.

In the case of a neck, head or other injury, the domes and helmets according to any of the variations described herein may be removed from a user in a manner that would avoid injury or be less likely to cause injury or further injury to the neck, spine or head. In contrast, for example, removing a traditional football helmet from a user's head requires significant force which could potentially move the cervical vertebrae and further injure the spinal cord. The domes and helmets according to any of the variations described herein may be removed without contacting the user's head or neck or without moving the vertebrae or spinal cord or without causing injury or harm or further injury or harm to the user. The domes or helmets may be removed from the user in a manner that would reduce or substantially reduce the likelihood of causing further injury to the user during the dome or helmet removal process or in a manner that would avoid injury. Similarly, the shoulder pads or the head and neck protection apparatus as a whole may be removed from a user in a manner that would reduce the chance of injury or avoid injury to the spine, neck or head.

Any of the head and neck protection apparatus described herein may be worn without a separate cap or helmet positioned on the user's head, within the dome or helmet of the head and neck protection apparatus. The various head and neck protection apparatus described herein are designed to surround but remain spaced apart from the user's head, making it unnecessary for the user to wear a separate cap on the user's head to protect the user's head from injury due to helmet impact.

Figure 9:
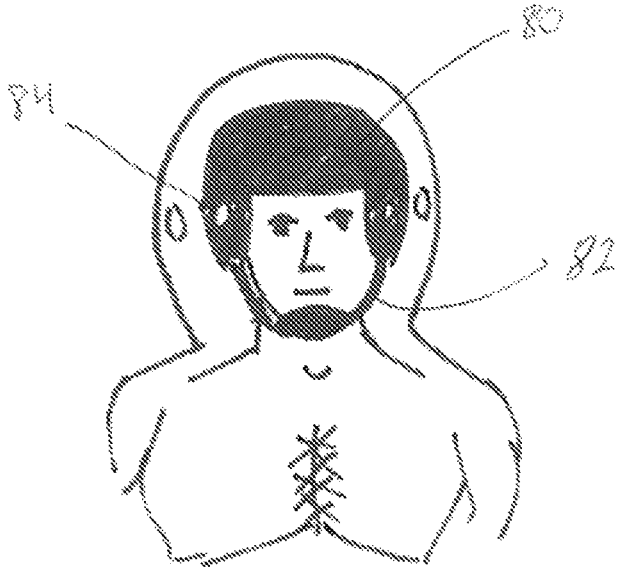
FIG. 9 illustrates a variation of an inner cap for use with a head and neck protection apparatus.

FIG. 9 illustrates a variation of an inner cap 80 which may optionally be worn with any variation of a head and neck protection apparatus as described herein. The cap 80 may include a chinstrap 82 or other latching or fastening mechanism for affixing or securing the cap 80 to the user's head. The cap 80 may be worn on a user's head, within a dome or helmet of a head and neck protection apparatus. The cap 80 may be made from rubber, plastic or other suitable material for absorbing or dampening any force to the head. The cap 80 may be padded and/or may include ear holes 84. The cap 80 may help prevent or reduce cranial injury or concussion to the head if the head were to somehow come into contact with the inner surface of a dome or helmet. Optionally, a logo or number may be placed on the cap or the dome or helmet.

In use, the various head and neck protection apparatus described herein may protect the user from injury by dispersing, distributing or redistributing a force applied to a helmet, e.g., an axial loading force or impact force, to or over a base, bottom or bottom surface of the helmet, or bottom periphery or circumference of the helmet surrounding an opening in the helmet, or other portion of the helmet, and from the base, bottom, bottom surface, bottom periphery or circumference of the helmet, or other portion of the helmet to or over a collar or a locking mechanism of the collar and/or shoulder pads, or over the circumference or periphery of a collar and/or shoulder pads, transferring the force to the shoulders, back and/or chest of the user. The force may be distributed or dispersed circumferentially or peripherally from the helmet to a collar or to a locking mechanism of the collar and/or to the shoulder pads. In certain variations, the connection between the helmet and a collar or shoulder pads may be such that every point or substantially every point along the bottom periphery, bottom surface or base of the helmet is in contact with the collar or the shoulder pads. In certain variations, when a force is applied to the helmet, the interaction or contact between the bottom periphery, surface or base of the helmet and a collar or shoulder pads may maximize the area over which a force applied to the helmet is dispersed or distributed and may result in the force being circumferentially or peripherally distributed or dispersed over or to the base or bottom periphery of the helmet and over a collar and/or shoulder pads or over the circumference or periphery of a collar and/or shoulder pads and/or over the entire or substantially entire shoulder area, back, chest and/or torso, rather than being transferred, focused or channeled solely to the users neck or to or solely to localized points on the user's head or body. In certain variations, the force to the helmet may be equally or substantially equally distributed or dispersed to the bottom periphery or circumference, bottom surface or base of the helmet and from the bottom periphery or circumference, bottom surface or base of the helmet to and over the periphery or circumference of a collar and/or the shoulder pads, ultimately transferring the force to the user's shoulders, chest, and/or back. The design of the head and neck apparatus may provide a dampening and/or reduction of the impact to the user's head, neck and/or spine from the force applied to the helmet. In certain variations, a force may be dispersed or distributed over the entire or at least a portion of the bottom periphery or circumference, bottom surface or base of the helmet, the periphery or circumference of a collar, shoulder pads, shoulders, chest, and/or back.

In one variation, a method for dispersing or distributing a force applied to a helmet to the shoulders of a user includes providing shoulder pads having a central opening for receiving a user's neck and a collar extending upward from or positioned at the periphery of the central opening. The base or bottom periphery of the helmet may be securely fastened to the collar such that the helmet cannot move relative to the shoulder pads and the helmet is configured to surround but remain spaced apart from the user's head allowing the user to turn their head fully in any direction within the helmet. A force applied to the helmet may be equally or substantially equally distributed or dispersed circumferentially or peripherally from a bottom periphery or base of the helmet to the collar, thereby transferring the force to the shoulders, back and/or chest of a user. The collar may include a locking mechanism for securely fastening the helmet to the shoulder pads. A base or bottom surface of the helmet or bottom periphery surrounding the helmet opening or the collar or shoulder pads may include an o-ring or a gasket that provides a locking seal between the helmet and the collar.

The helmet may be securely fastened to the collar by opening a latch on the collar to expand the collar and inserting a portion of the helmet into the expanded collar. The latch is then closed to securely fasten the helmet to the collar and to the shoulder pads. In another variation, a plurality of protrusions located along an outer surface of a base or bottom portion or bottom periphery of the helmet may be inserted into a plurality of slots located along an inner surface of the collar. The helmet is rotated such that the helmet base or bottom portion of the helmet is rotated relative to the collar, locking the protrusions within the slots. The helmet may be in form of a clear dome or a cage. Optionally, in certain variations, the base or bottom periphery or other portion of the helmet may be securely fastened or attached to the shoulder pads such that the helmet cannot move relative to the shoulder pads and the helmet is configured to surround but remain spaced apart from the user's head, and the shoulder pads may not include a collar.

The helmets, e.g., the various domes or cages described herein, may be made from a variety of materials suitable for withstanding force or tremendous force, e.g., axially loaded forces, impact forces, or other forces, without cracking or shattering. Materials include but are not limited to Plexiglas™, polymethyl methacrylate (PMMA), fiberglass, metal, and hard plastics. The domes may be completely or at least partially clear to allow for visibility by the user in any direction. The domes may include holes or slits for ventilation, hearing and/or speaking. The cage may be metallic and/or may be wrapped or encased in rubber, padding material, resilient material or other material suitable for absorbing shock and/or softening or dampening the impact to the cage and to the user. The helmets also allow for improved visualization of the players faces for spectators and television coverage.

As described supra, the helmet may be spaced apart from the head providing space around the entire or substantially entire head of the user such that the head does not contact the inner surface of the helmet when the helmet is securely fastened to the shoulder pads. The helmet may allow for complete or a wide range of motion of the head. Indeed, the head of the user may be in spaced relation to the inside surfaces of the helmet, providing a user with full or substantially full mobility of motion of the head and good all-around visibility. Because the user's head may not contact the helmet, the helmet prevents concussive affects from a helmet to helmet collision or blow.

The base, bottom periphery or bottom of a helmet in any of the variations described herein may surround the opening of the helmet for receiving the user's head. The base or bottom periphery of a helmet may extend about the rear, front and/or sides of a bottom or bottom surface of a helmet. In certain variations, the base, bottom surface or bottom periphery of the helmet and/or the collar may have a variety of shapes, e.g., annular or circular. In certain variations, the base, bottom or bottom periphery of the helmet or other portion of the helmet may be attached or connected to the collar by being received within the collar. In other variations, the base, bottom or bottom periphery of the helmet or other portion of the helmet may surround the collar. Optionally, the base or bottom or bottom periphery of the helmet and the collar may be concentrically arranged or connected. In certain variations, once the helmet is locked to the shoulder pads, minimal mobility between the helmet and shoulder pads may remain. In certain variations, the collar may extend upward from a periphery of a central opening in the shoulder pads or the collar may be positioned at or around a periphery of the centrally opening or on a surface or other portion of the shoulder pads. In other variations, the base or bottom or bottom periphery of the helmet or other portion of the helmet may be attached or connected directly to the shoulder pads and the shoulder pads may not have a collar.

In certain variations, the shoulder pads may include padding to soften or dampen the impact to the musculature of the shoulders, chest and/or back. Padding may extend down as far as the waist to provide protection to the user's rib cage, lower back and abdomen. The shoulder pads may include straps, strings or buckles to allow for adjustment to fit users of various sizes and to secure the pads to the user.

The various head and neck protection apparatus described herein may be worn by a user participating in a variety of sports or activities were contact with other participants and/or objects may occur or where there exists a risk of injury to the head/brain, neck, or spine. Examples of such sports or activities include but are not limited to: football, lacrosse, hockey, driving, motor-cross, cycling, riot control, fire fighting, etc. The various head and neck protection apparatus described herein would be suitable for various users, including but not limited to: professional athletes, children participating in pee-wee sports or junior sports, and athletes of all ages all the way up through high school and college.

The head and neck protection apparatus described herein may protect the user from various injuries, including, but not limited to: injury to the neck from hyper-extension or flexion injuries, direct axial loading injuries, concussions, brain injuries, cervical spine injuries, fractures, ligamentous injuries, spinal cord injuries, and/or paralysis.

Each of the individual variations described and illustrated herein has discrete components and features which may be readily separated from or combined with the features of any of the other variations. Modifications may be made to adapt a particular situation, material, composition of matter, process, process act(s) or step(s) to the objective(s), spirit or scope of the present invention.

Methods recited herein may be carried out in any order of the recited events which is logically possible, as well as the recited order of events. Furthermore, where a range of values is provided, every intervening value between the upper and lower limit of that range and any other stated or intervening value in that stated range is encompassed within the invention. Also, any optional feature of the inventive variations described may be set forth and claimed independently, or in combination with any one or more of the features described herein.

All existing subject matter mentioned herein (e.g., publications, patents, patent applications and hardware) is incorporated by reference herein in its entirety except insofar as the subject matter may conflict with that of the present invention (in which case what is present herein shall prevail). The referenced items are provided solely for their disclosure prior to the filing date of the present application. Nothing herein is to be construed as an admission that the present invention is not entitled to antedate such material by virtue of prior invention.

Reference to a singular item, includes the possibility that there are plural of the same items present. More specifically, as used herein and in the appended claims, the singular forms "a," "an," "said" and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation. Unless defined otherwise, all technical and scientific terms used herein have the same meaning as commonly understood by one of ordinary skill in the art to which this invention belongs.

This disclosure is not intended to be limited to the scope of the particular forms set forth, but is intended to cover alternatives, modifications, and equivalents of the variations described herein. Further, the scope of the disclosure fully encompasses other variations that may become obvious to those skilled in the art in view of this disclosure. The scope of the present invention is limited only by the appended claims.

What is claimed is:

1. A head and neck protection apparatus comprising:

shoulder pads having a central opening for receiving a user's neck and padding to provide protection against an impact force;

a collar extending from the periphery of the central opening; and a helmet comprising a dome portion configured to surround but remain spaced apart from the user's head, wherein the dome portion extends along an entire circumference of the helmet, wherein the entire dome portion is made of a transparent material and has one or more openings formed therethrough, the helmet including a bottom periphery surrounding an opening for receiving the user's head, wherein the bottom periphery surrounds an entire circumference of the opening, wherein the entire bottom periphery of the helmet is removably connected to the collar such that the helmet cannot move relative to the shoulder pads and a force applied to the helmet is distributed circumferentially or peripherally to the collar and transferred to the user's shoulders, wherein the entire bottom periphery of the helmet is circumferentially locked to the collar when connected, the collar comprising a locking mechanism for securely connecting the helmet to the shoulder pads wherein the entire bottom periphery of the helmets is received within the collar, and wherein the helmet is completely detachable from the collar.

2. The apparatus of claim 1, wherein the collar is an expandable collar and wherein the locking mechanism is a latch, the collar being configured to receive the helmet when the locking mechanism is a latch, the collar being configure to receive the helmet when the latch is in an open position and to securely connect the helmet to the shoulder pads when the latch is in a closed position.

3. The apparatus of claim 1, wherein the helmet comprising an o-ring or gasket that provides a seal between the helmet and the collar.

4. The apparatus of claim 1, wherein the collar comprises an o-ring or gasket that provides a seal between the helmet and collar.

5. The apparatus of claim 1, wherein the locking mechanism comprises a plurality of slots or protrusions located along a surface of the collar and wherein the helmet comprises a plurality of protrusions or slots located along a surface of the bottom periphery of the helmet, wherein the protrusions are inserted into the slots to lock the helmet to the collar.

6. The apparatus of claim 1, wherein the entire bottom periphery of the helmet is circumferentially sealed to the collar when connected.

7. A head and neck protection apparatus comprising:

shoulder pads having a central opening for receiving a user's neck and padding to provide protection against an impact force;

a collar extending from the periphery of the central opening; and a helmet comprising a dome portion configured to surround but remain spaced apart from the user's head, wherein the dome portion extends along an entire circumference of the helmet, wherein the entire dome portion is in the form of a cage having a plurality of openings formed therethrough, the helmet including a bottom periphery surrounding an opening for receiving the user's head, wherein the bottom periphery surrounds an entire circumference of the opening, wherein the entire bottom periphery of the helmet is removably connected to the collar such that the helmet cannot move relative to the shoulder pads and a force applied to the helmet is distributed circumferentially or peripherally to the collar and transferred to the user's shoulders, wherein the entire bottom periphery of the helmet is circumferentially locked to the collar when connected, the collar comprising a locking mechanism for securely connecting the helmet to the shoulder pads wherein the entire bottom periphery of the helmet is received within the collar, wherein the locking mechanism comprises a plurality of slots or protrusions located along a surface of the collar and wherein the helmet comprises a plurality of protrusions or slots located along a surface of the bottom periphery of the helmet, wherein the protrusions are inserted into the slots to lock the helmet to the collar, and wherein the helmet is completely detachable from the collar.

* * * * *